US008454764B2

(12) United States Patent
Logan et al.

(10) Patent No.: US 8,454,764 B2
(45) Date of Patent: Jun. 4, 2013

(54) NI-25 HEAT-RESISTANT NODULAR GRAPHITE CAST IRON FOR USE IN EXHAUST SYSTEMS

(75) Inventors: Robert Logan, Brantford (CA); Delin Li, Waterloo (CA); Shuzhi Yu, Brantford (CA); Gangjun Liao, Brantford (CA)

(73) Assignee: Wescast Industries, Inc., Brantford, Ontario (CA)

( * ) Notice: Subject to any disclaimer, the term of this patent is extended or adjusted under 35 U.S.C. 154(b) by 184 days.

(21) Appl. No.: 12/919,044

(22) PCT Filed: Feb. 25, 2008

(86) PCT No.: PCT/US2008/054826

§ 371 (c)(1),
(2), (4) Date: Aug. 24, 2010

(87) PCT Pub. No.: WO2009/108181

PCT Pub. Date: Sep. 3, 2009

(65) Prior Publication Data

US 2011/0011070 A1 Jan. 20, 2011

(51) Int. Cl.

| | |
|---|---|
| ***C22C 37/08*** | (2006.01) |
| ***C22C 37/04*** | (2006.01) |
| ***F02B 53/00*** | (2006.01) |

(52) U.S. Cl.

USPC ..... 148/324; 148/321; 148/327; 420/15; 420/22; 420/28; 60/324

(58) Field of Classification Search

USPC ..... 148/321, 327, 324; 420/15, 22, 28

See application file for complete search history.

(56) References Cited

U.S. PATENT DOCUMENTS

| | | | | |
|---|---|---|---|---|
| 4,528,045 | A | 7/1985 | Tanaka et al. | |
| 4,790,977 | A | 12/1988 | Daniels et al. | |
| 5,049,354 | A | 9/1991 | Nishimura et al. | |
| 5,106,578 | A | 4/1992 | Ohtsuka et al. | |
| 6,383,310 | B1 * | 5/2002 | Otsuka et al. | 148/327 |
| 6,508,981 | B1 * | 1/2003 | Perrin et al. | 420/28 |
| 6,685,881 | B2 | 2/2004 | Hamano et al. | |
| 6,852,276 | B2 | 2/2005 | Kim | |
| 7,153,373 | B2 | 12/2006 | Maziasz et al. | |
| 7,156,929 | B2 * | 1/2007 | Menk | 148/321 |
| 7,244,755 | B2 | 7/2007 | Fisher et al. | |

(Continued)

FOREIGN PATENT DOCUMENTS

| | | | |
|---|---|---|---|
| JP | 61-009550 | A | 1/1986 |
| JP | 63-060255 | A | 3/1988 |

(Continued)

*Primary Examiner* — Kenneth Bomberg
*Assistant Examiner* — Dapinder Singh
(74) *Attorney, Agent, or Firm* — Dickinson Wright PLLC

(57) ABSTRACT

A nodular graphite, heat-resistant cast iron composition for use in engine systems. The composition contains carbon 1.5-2.4 weight %, silicon 5.4-7.0 weight %, manganese 0.5-1.5 weight %, nickel 22.0-28.0 weight %, chromium 1.5-3.0 weight %, molybdenum 0.1-1.0 weight %, magnesium 0.03-0.1 weight %, and a balance weight % being substantially iron. The composition has an austenitic matrix. Additionally, the composition exhibits excellent oxidation resistance at high temperature and excellent mechanical properties at both room and high temperatures. Thus, the composition can be a lower cost substitute material for Ni-Resist D5S under thermocycling conditions experienced by exhaust gas accessories and housings such as engine exhaust manifolds, turbocharger housings, and catalytic converter housings.

4 Claims, 3 Drawing Sheets

U.S. PATENT DOCUMENTS

| | | | | |
|---|---|---|---|---|
| 7,431,576 | B2 * | 10/2008 | Sun | 418/179 |
| 2003/0007882 | A1 * | 1/2003 | Perrin et al. | 420/22 |
| 2003/0051776 | A1 * | 3/2003 | Enya et al. | 148/321 |
| 2005/0189045 | A1 * | 9/2005 | Takayama et al. | 148/612 |
| 2006/0191604 | A1 | 8/2006 | Itoh et al. | |
| 2007/0107816 | A1 | 5/2007 | Frommeyer et al. | |
| 2008/0274005 | A1 * | 11/2008 | Liao et al. | 420/15 |

FOREIGN PATENT DOCUMENTS

| | | | |
|---|---|---|---|
| JP | 63-114938 | A | 5/1988 |
| JP | 6-128684 | | 5/1994 |
| WO | WO 2006/084838 | A1 | 8/2006 |

* cited by examiner

NI-25 HEAT-RESISTANT NODULAR GRAPHITE CAST IRON FOR USE IN EXHAUST SYSTEMS

CROSS REFERENCE TO RELATED APPLICATIONS

This U.S. National Stage patent application claims priority to PCT Patent Application International Serial No. PCT/US2008/054826 filed on Feb. 25, 2008, entitled "Ni-25 Heat-Resistant Nodular Graphite Cast Iron For Use In Exhaust Systems", the entire disclosure of that application being considered part of the disclosure of this application and hereby incorporated by reference.

BACKGROUND OF THE INVENTION

1. Field of the Invention

The present invention relates to a NiSiCr-alloyed heat-resistant cast iron composition that has an austenitic matrix and nodular graphite in the microstructure. The composition exhibits excellent oxidation resistance and mechanical properties at elevated temperatures. The composition is suitable for components exposed to high temperatures and mechanical loading, especially those components in automobile engine systems such as exhaust manifolds, turbocharger housings, and catalytic converter housings.

2. Description of the Prior Art

There are currently, sorted by matrix structure, two types of heat-resistant cast irons used for engine exhaust components, ferritic and austenitic. Alloyed ferritic cast irons with nodular or vermicular graphite, of which silicon-molybdenum alloyed cast irons are most widely used, exhibit good oxidation resistance and mechanical properties at high temperature. As automobile engine exhaust temperature trends upward, more austenitic heat-resistant cast irons are employed when the temperature is so high that ferritic cast irons cannot meet the requirements in oxidation resistance and mechanical properties, especially yield strength and ultimate tensile strength.

The worldwide most frequently used austenitic cast iron in engine exhaust applications is Ni-Resist D5S in ASTM A439. This material is a high-alloyed nodular graphite cast iron comprising by weight less than 2.3% C, 4.9-5.5% Si, less than 1.0% Mn, 34-37% Ni and 1.75-2.25% Cr, with a minimum elongation of 10%, a minimum yield strength of 207 MPa and a minimum ultimate tensile strength of 449 MPa at room temperature. This material provides excellent oxidation resistance and superior yield strength and ultimate tensile strength over ferritic cast irons at high temperature. However, this is an expensive solution because the material has a very high nickel content.

Within the public domain, other documents exist regarding austenitic cast irons than Ni-Resist D5S for high temperature applications such as D4 in ASTM A439 comprising by weight 28-32% Ni, 4.5-5.5% Cr and 5-6% Si, and D4A in ASTM A439 comprising by weight 29-32% Ni, 1.5-2.5% Cr and 4-6% Si. The former has sufficient oxidation resistance, but does not have sufficient elongation because of the high Cr content that forms continuous interdendritic carbides. The latter has similar mechanical properties to Ni-Resist D5S, but does not have adequate oxidation resistance. Besides, these materials all have relatively high nickel content that leads to a higher cost solution.

Patent publication U.S.2006/0191604 discloses an austenitic heat-resistant spheroidal graphite cast iron comprising by weight 1-3.5% of C, 1-6.5% of Si, 3% or less of Cr, 10-40% of Ni, 1-4.5% of Mo, and 0.001-0.5% of Sn and/or Sb as (2Sn+Sb) and 0.1% or less of graphite-spheriodizing element. This material achieves good oxidation resistance and good yield strength by adding a large amount of expensive element Mo and keeping nickel and silicon contents at a high level as shown in the presented examples that contain 1.18-4.49% of Mo, 26.9-35.9% of Ni and 3.75-5.13% of Si. This makes the material less economically attractive. Also, the room temperature elongation of the described examples in this publication ranges from 2.1-5.3%, which is significantly lower than that of Ni-Resist D5S and cannot meet the specifications for most automobile engine exhaust components.

There are publications describing austenitic heat-resistant cast irons with lower nickel content such as U.S. Pat. No. 4,528,045 that discloses a spheroidal graphite cast iron comprising 18-24% of Ni, 3-5% of Cr and 3.5-6% of Si by weight. This material has higher oxidation resistance than Ni-Resist D5S, but does not have sufficient room temperature elongation because of the high chromium content.

Another material option for engine exhaust components is using high-alloyed heat-resistance cast steels. Some of the austenitic steels can provide better oxidation resistance and mechanical properties than Ni-Resist at both room and elevated temperatures. However, these steels have much higher melting points than cast iron and may have poor castability, which leads to high energy consumption and makes the production process more complicated and expensive. Consequently, the process costs of these cast steels will be inevitably higher than that of austenitic cast irons.

Accordingly, the object of the present invention is to provide a lower cost austenitic heat-resistant cast iron that possesses similar or improved oxidation resistance, yield and ultimate tensile strengths and elongation to those of Ni-Resist D5S at room and high temperatures. This composition would be a substitute for Ni-Resist D5S in engine systems.

SUMMARY OF THE INVENTION AND ADVANTAGES

Accordingly, the invention provides for a heat resistant, nodular graphite cast iron composition consisting essentially of carbon 1.5-2.4 weight %, silicon 5.4-7.0 weight %, manganese 0.5-1.5 weight %, nickel 22.0-28.0 weight %, chromium 1.5-3.0 weight %, molybdenum 0.1-1.0 weight %, magnesium 0.03-0.1 weight %, and a balance weight % being substantially iron. This composition exhibits excellent oxidation resistance at high temperature, and high elongation and strength at both room and elevated temperatures. The oxidation resistance and mechanical properties of this composition are comparable to those of Ni-Resist D5S. The cost of the composition of the present invention, however, is significantly lower than that of Ni-Resist D5S, due to reduced nickel content.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
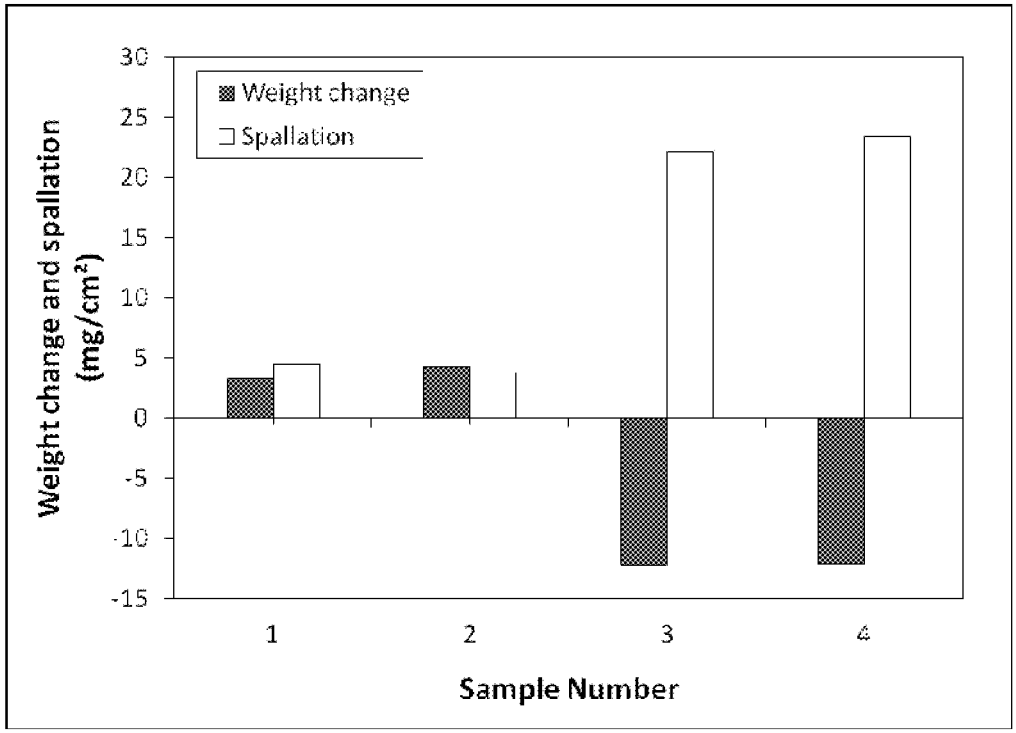
FIG. 1 is a bar graph showing the weight change and oxide scale spallation of the iron of the present invention (Sample No. 1) and the comparative samples (No. 2 through No. 4) after being exposed to 800° C. for 200 hours.

Referring to the Figures, wherein like numerals indicate corresponding parts throughout the several views, the invention is a heat resistant, nodular graphite cast iron composition consisting essentially of; carbon 1.5-2.4 weight %, silicon 5.4-7.0 weight %, manganese 0.5-1.5 weight %, nickel 22.0-28.0 weight %, chromium 1.5-3.0 weight %, molybdenum 0.1-1.0 weight %, magnesium 0.03-0.1 weight %, phosphorous up to and including 0.04 weight %, sulfur up to and including 0.02 weight %, rare-earth elements up to and including 0.005 weight %, and a balance weight % consisting of iron and incidental elements and impurities.

Reasons for the concentration ranges of the alloying elements described above are explained below.

The amount of carbon in the composition must be in the range of 1.5-2.4 weight %. Carbon is the element that forms graphite in cast iron that assures superior machinability of cast iron over steel. Carbon is also the main element assuring superior castability of cast iron by forming the eutectic alloy with iron, which exhibits the lowest melting temperature. However, if the carbon content is excessively high, large primary graphite nodules will form in the composition and lower the elongation and strength of the composition. A eutectic composition is ideal for achieving a desirable graphite structure and the best castability.

The eutectic point of the composition falls at the Carbon Equivalent (CE) point of 4.3. With cast irons containing high nickel, CE is calculated as follows:

$$CE=C+0.33Si+0.047Ni-0.0055SiNi$$

In the formula above, CE represents carbon equivalent; C, Si and Ni represent carbon content, silicon content, and nickel content, respectively, by weight percentage in the cast iron.

With silicon ranging from 5.4 to 7.0 weight % and nickel from 22.0 to 28.0 weight %, the reason of which will be explained later, carbon content must be in the range of 1.5 to 2.4 weight % to achieve a composition close to the eutectic point of 4.3.

The amount of silicon in the composition must be in the range of 5.4-7.0 weight %. Silicon is a major alloying element to improve oxidation resistance in the composition. It also has a graphitizing effect on the composition, as it does on other cast irons. A minimum silicon content of 5.4 weight % is required to achieve an equivalent oxidation resistance on the cast iron of the present invention to that of Ni-Resist D5S. Although the oxidation resistance of the composition increases with silicon content, excessive silicon leads to insufficient elongation. Therefore, the silicon content is limited to a range of 5.4 to 7.0 weight %.

The amount of manganese in the composition must be in the range of 0.5-1.5 weight %. Manganese prevents secondary graphite precipitation, which has a detrimental effect on thermal fatigue strength of austenitic nodular graphite cast iron. Manganese is also an austenite stabilizer. However, manganese deteriorates oxidation resistance and promotes carbide formation that lowers the elongation of cast iron. Accordingly, the preferred manganese content in the composition is between 0.5 and 1.5 weight %.

The amount of nickel in the composition is in the range of 22.0 to 28.0 weight %. Nickel is the main austenite stabilizing element in the composition. It also improves the oxidation resistance and strength of the composition. Therefore, a minimum nickel content of 22.0 weight % is required to achieve a stable enough austenite at all temperatures and sufficient oxidation resistance required by accessories in engine systems such as exhaust manifolds, turbocharger housings, and other components in the hot end system. Nickel, however, is an expensive metal and hence adds the most cost to the composition. A preferred maximum nickel content of 28.0 weight % is set for cost reasons.

The amount of chromium in the composition must be in the range of 1.5-3.0 weight %. Chromium improves oxidation resistance and high temperature strength of the composition. However, the elongation of the composition decreases with increasing chromium content due to its carbide forming effect. To balance between oxidation resistance, strength, and elongation, the chromium content is limited to the range of 1.5 to 3.0 weight %.

The amount of molybdenum in the composition must be in the range of 0.1-1.0 weight %. A small amount of molybdenum is added to the composition to further stabilize the austenite matrix so that it will not decompose in any thermocycling conditions. For this purpose, 0.1-1.0 weight % of molybdenum is required.

The amount of magnesium in the composition must be in the range of 0.03-0.1 weight %. Magnesium serves as the graphite nodularizing element. Insufficient magnesium leads to degenerated graphite nodules or even flake graphite in the composition. Excessive magnesium also results in undesirable graphite morphologies. Consequently the content of magnesium is limited to the range of 0.03 to 0.1 weight %.

In the cast iron production environment there are always other incidental elements and impurities, besides the alloying elements mentioned above. In the present invention, sulfur and phosphorous are inevitable impurities, which have detrimental effects on the microstructure and mechanical properties of the composition. Consequently, the content of sulfur and phosphorous in the composition must be less than 0.02 weight % and 0.04 weight % respectively, as in conventional nodular graphite cast iron.

The total content of rare-earth elements in the composition must be as low as possible, preferably below 0.005 weight %. It is to be noted that rare-earth elements, such as cerium and lanthanum, which are frequently used for graphite nodularization in conventional ferritic ductile iron, deteriorate the morphology of graphite nodules in the composition.

The composition of the present invention possesses similar oxidation resistance at high temperature, and similar mechanical properties at room temperature and high temperature, to those of Ni-Resist D5S. Properties of the present invention, together with comparative cast irons, will be described with examples in more details hereafter.

To compare the properties of the present invention with comparative materials, 12.5 mm thick Y-blocks were employed. Rectangular samples cut from the Y-blocks, with all six sides ground, were used for oxidation tests. Round test bars of 6.35 mm in diameter and 25.4 mm of gauge length, machined from the Y-blocks, were used for tensile tests.

Oxidation resistance is one of the key properties of a cast iron used in high temperature applications. When an austenitic cast iron is oxidized at high temperature, the oxide scales on the surface partially spalls off when it is later cooled to room temperature. Oxide spallation from an automobile engine system may impair the function of the engine. Therefore, oxidation resistance is measured in the present invention by weight change of the samples and the amount of spalled oxide scales. Oxidation tests were conducted at 800° C. for 200 hours in air atmosphere.

The results of the oxidation tests on the example cast iron of the present invention and comparative cast irons are shown in FIG. 1. The chemical analysis of the examples is given in Table 1. Sample No. 1 is an example of the present invention. Samples No. 2 through No. 4 are comparative examples with No. 2 representing Ni-Resist D5S.

TABLE 1

| Chemical composition 10 (% by weight) | | | | | | | | | | |
|---|---|---|---|---|---|---|---|---|---|---|
| Sample No. | C | Si | Mn | Ni | Cr | Mo | Mg | P | S | Notes |
| 1 | 1.88 | 5.85 | 0.69 | 25.2 | 2.04 | 0.12 | 0.065 | 0.010 | 0.012 | present invention |
| 2 | 2.05 | 5.18 | 0.66 | 35.0 | 1.95 | 0.15 | 0.085 | 0.010 | 0.013 | comparative example |
| 3 | 2.08 | 5.57 | 0.68 | 20.0 | 1.92 | 0.16 | 0.059 | 0.010 | 0.012 | comparative example |
| 4 | 2.13 | 5.00 | 0.64 | 30.7 | 1.97 | 0.23 | 0.071 | 0.008 | 0.011 | comparative example |

As seen in FIG. 1, Sample No. 1 and No. 2 exhibit weight gain while Sample No. 3 and No. 4 show weight loss. The weight change and spallation of Sample No. 1, which is an example of the present invention, are similar to those of Ni-Resist D5S (Sample No. 2). Samples No. 3 and No. 4 show much higher spallation than Samples No. 1 and No. 2. Sample No. 3 cannot achieve the same level of oxidation resistance as Ni-Resist D5S because its nickel content is too low. Sample No. 4, despite its higher nickel content than that of the present invention, cannot achieve the same oxidation resistance as Ni-Resist D5S either because of its inadequate silicon content.

It is thus clear that an appropriate combination of nickel and silicon contents is the key to achieving satisfactory oxidation resistance. The present invention utilizes that combination to achieve its excellent oxidation resistance.

Figure 2:
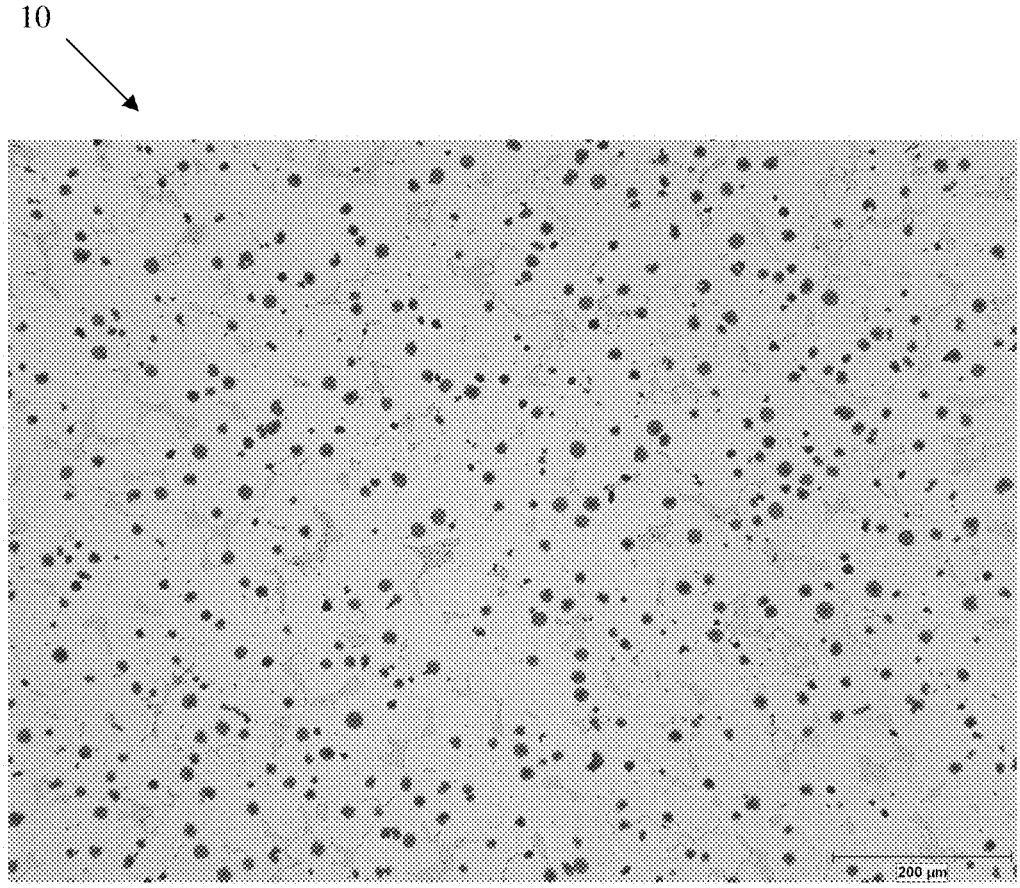
FIG. 2 is a micrograph taken of the composition of the present invention illustrating the morphology of the constituents in the microstructure of the composition.

Beside chemical composition, microstructure of a cast iron is another important factor affecting oxidation resistance as well as mechanical properties. High nodularity and even distribution of graphite particles in the microstructure of a heat-resistant nodular graphite cast iron are essential for oxidation resistance and mechanical properties. FIG. 2 presents a micrograph taken from Sample No. 1, the present invention. The microstructure shown in FIG. 2 has a nodularity of 90.4% and a nodule count of 444 per square millimeter, suggesting that the present invention yields a high nodularity and evenly distributed graphite nodules.

Sufficient mechanical properties, especially elongation, yield strength and ultimate tensile strength at room and high temperatures are also critical for components working under thermocycling conditions, such as that experienced by engine system accessories. Table 2 presents the elongation, yield strength and ultimate tensile strength of the present invention and the comparative samples listed in Table 1.

TABLE 2

| Mechanical properties at room temperature and 900° C. | | | | | | |
|---|---|---|---|---|---|---|
| | RT | | | 900° C. | | |
| Sample No. | Elongation (%) | YS (Mpa) | UTS (Mpa) | Elongation (%) | YS (Mpa) | UTS (Mpa) |
| 1 | 20.8 | 240 | 481 | 28.3 | 43 | 63 |
| 2 | 22.8 | 224 | 490 | 42.3 | 44 | 63 |
| 3 | 24.6 | 241 | 521 | 25.7 | 49 | 67 |
| 4 | 25.0 | 226 | 479 | 30.9 | 46 | 66 |

As seen in Table 2, the present invention (Sample No. 1) has similar yield strength and ultimate tensile strength to Ni-Resist D5S (Sample No. 2) at both room temperature and 900° C. The elongation of the present invention reaches 20% at room temperature, which by far exceeds the specified minimum value of 10% for Ni-Resist D5S. At 900° C., the elongation of the present invention is even higher than at room temperature and is thus adequate for exhaust gas accessories such as exhaust manifolds, turbocharger housings and catalytic converter housings. Samples No. 3 and No. 4 also exhibit similar mechanical properties to those of Ni-Resist D5S, but their oxidation resistance is far too low compared to Ni-Resist D5S (Sample No. 2), as indicated in FIG. 1. The composition, as described above, has comparable oxidation resistance and mechanical properties to Ni-Resist D5S and thus can be a substitute material for Ni-Resist D5S for applications including, but not limited to, exhaust manifolds, turbocharger housings and catalytic converter housings, with the advantage of reduced cost because of its lower nickel content.

Figure 3:
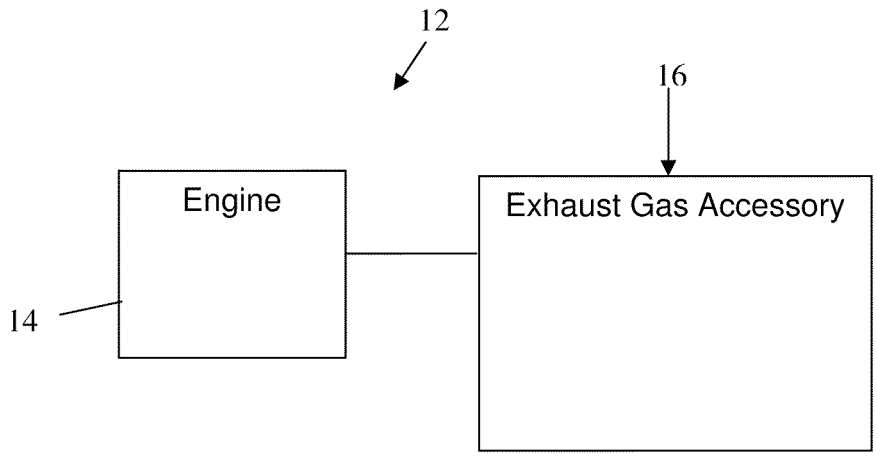
FIG. 3 is a schematic of the engine system.

In addition to the composition, the present invention further includes an engine system 12, generally shown in FIG. 3, containing the claimed heat resistant, nodular graphite cast iron composition. The engine system 12 comprises an engine 14 for generating an exhaust gas. An exhaust gas accessory 16 is generally indicated and is in fluid communication with the engine 14 for receiving or containing exhaust gases from the engine 14. The exhaust gas accessory 16 is typically an automobile exhaust system component exposed to high temperature and mechanical loading, such as an exhaust manifold, turbocharger housing, or catalytic converter housing. At least part of the exhaust gas accessory 16 consists essentially of carbon 1.5-2.4 weight %, silicon 5.4-7.0 weight %, manganese 0.5-1.5 weight %, nickel 22.0-28.0 weight %, chromium 1.5-3.0 weight %, molybdenum 0.1-1.0 weight %, magnesium 0.03-0.1 weight %, and a balance weight % consisting of iron and incidental elements and impurities. In an additional embodiment of the invention, the exhaust gas accessory 16 additionally includes phosphorus up to and including 0.04 weight %, sulfur up to and including 0.02 weight %, and rare-earth elements up to and including 0.05 weight %. The exhaust gas accessory 16 preferably has an elongation of at least 10% at room temperature and at least 20% at 900° C., a yield strength of at least 207 MPa at room temperature and at least 40 MPa at 900° C., and an ultimate tensile strength of at least 449 MPa at room temperature and at least 60 MPa at 900° C.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A heat resistant, nodular graphite cast iron composition consisting essentially of carbon 1.5-2.4 weight %, silicon 5.4-7.0 weight %, manganese 0.5-0.69 weight %, nickel 25.2-28.0 weight %, chromium 1.5-2.04 weight %, molybdenum 0.1-1.0 weight %, magnesium 0.03-0.1 weight %, and the balance weight % being iron and incidental elements and impurities.

2. A composition as set forth in claim 1 consisting essentially of carbon 1.88 weight %, silicon 5.85 weight %, manganese 0.69 weight %, nickel 25.2 weight %, chromium 2.04 weight %, molybdenum 0.12 weight %, magnesium 0.065 weight %, and the balance weight % being iron and incidental elements and impurities.

3. An engine system (12) comprising;

an engine (14) for generating an exhaust gas, an exhaust gas accessory (16) in fluid communication with said engine (14) for receiving or containing the exhaust gases from said engine (14), wherein said exhaust gas accessory (16) at least in part consists essentially of carbon 1.5-2.4 weight %, silicon 5.4-7.0 weight %, manganese 0.5-0.69 weight %, nickel 25.2-28.0 weight %, chromium 1.5-2.04 weight %, molybdenum 0.1-1.0 weight %, magnesium 0.03-0.1 weight %, and the balance weight % being iron and incidental elements and impurities.

4. A system (12) as set forth in claim 3, wherein said exhaust gas accessory (16) at least in part consists essentially of carbon 1.88 weight %, silicon 5.85 weight %, manganese 0.69 weight %, nickel 25.2 weight %, chromium 2.04 weight %, molybdenum 0.12 weight %, magnesium 0.065 weight %, and the balance weight % being iron and incidental elements and impurities.

* * * * *